US006292780B1

(12) United States Patent
Doederlein et al.

(10) Patent No.: US 6,292,780 B1
(45) Date of Patent: Sep. 18, 2001

(54) TALKING TRADING CARD PLAYER SYSTEM

(75) Inventors: Dieter D. Doederlein, Mississauga; G. Dale Newman, Unionville; Anthony C. Sharp, Agincourt, all of (CA); Michael E. Lucas, Cupertino, CA (US)

(73) Assignee: Micra SoundCards, Inc., Ontario (CA)

( * ) Notice: Subject to any disclaimer, the term of this patent is extended or adjusted under 35 U.S.C. 154(b) by 0 days.

(21) Appl. No.: 08/990,509

(22) Filed: Dec. 15, 1997

Related U.S. Application Data

(63) Continuation-in-part of application No. 08/519,839, filed on Aug. 25, 1995.

(51) Int. Cl.[7] ..... G10L 21/00
(52) U.S. Cl. ..... 704/270; 704/275
(58) Field of Search ..... 704/276, 275

(56) References Cited

U.S. PATENT DOCUMENTS

| | | | |
|---|---|---|---|
| 3,524,272 | 8/1970 | Elwell . | |
| 3,691,312 | 9/1972 | Petersen . | |
| 4,159,417 | 6/1979 | Rubincam . | |
| 4,287,568 | 9/1981 | Lester . | |
| 4,607,747 | 8/1986 | Steiner . | |
| 4,648,086 | 3/1987 | Koike . | |
| 4,791,741 | 12/1988 | Kondo . | |
| 4,980,919 | 12/1990 | Tsai . | |
| 5,026,058 | 6/1991 | Bromley . | |
| 5,045,327 | 9/1991 | Tarlow et al. . | |
| 5,056,145 | 10/1991 | Yamamoto et al. . | |
| 5,118,299 | 6/1992 | Burns et al. | 439/74 |
| 5,179,517 | 1/1993 | Sarbin et al. . | |
| 5,181,744 | 1/1993 | Betheil . | |
| 5,212,368 | 5/1993 | Hara . | |
| 5,285,437 | 2/1994 | Yokota et al. . | |
| 5,325,463 | 6/1994 | Murata et al. . | |
| 5,359,698 | 10/1994 | Goldberg et al. . | |
| 5,365,686 | 11/1994 | Scott . | |
| 5,411,259 | 5/1995 | Pearson et al. . | |
| 5,480,156 | 1/1996 | Doederlein et al. . | |
| 5,588,678 | 12/1996 | Young . | |
| 5,641,164 | 6/1997 | Doederlein et al. . | |
| 5,836,616 | 11/1998 | Cooper | 283/56 |

FOREIGN PATENT DOCUMENTS 42 07 447 9/1993 (DE) .

OTHER PUBLICATIONS

ISD1012A/1016A/1020A Single–Chip Voice Record/Playback Devices.

*Primary Examiner*—Fan Tsang
*Assistant Examiner*—Michael N. Opsasnick
(74) *Attorney, Agent, or Firm*—McDermott, Will & Emery

(57) ABSTRACT

A talking trading card playing system consists of a portable card player and a plurality of trading cards. Each card includes a card body having front and back surfaces, flexible sheets affixed to the front surface and to the back surface of the housing, and a voice chip for storing and generating sound patterns. The portable player comprises a power source located in the housing for supplying electrical power to the voice chip, and sound generation components. The subject trading card and player may be activated by aligning the card with electrical contacts on the face of the player, thereby establishing electrical contact between the card and the player.

17 Claims, 7 Drawing Sheets

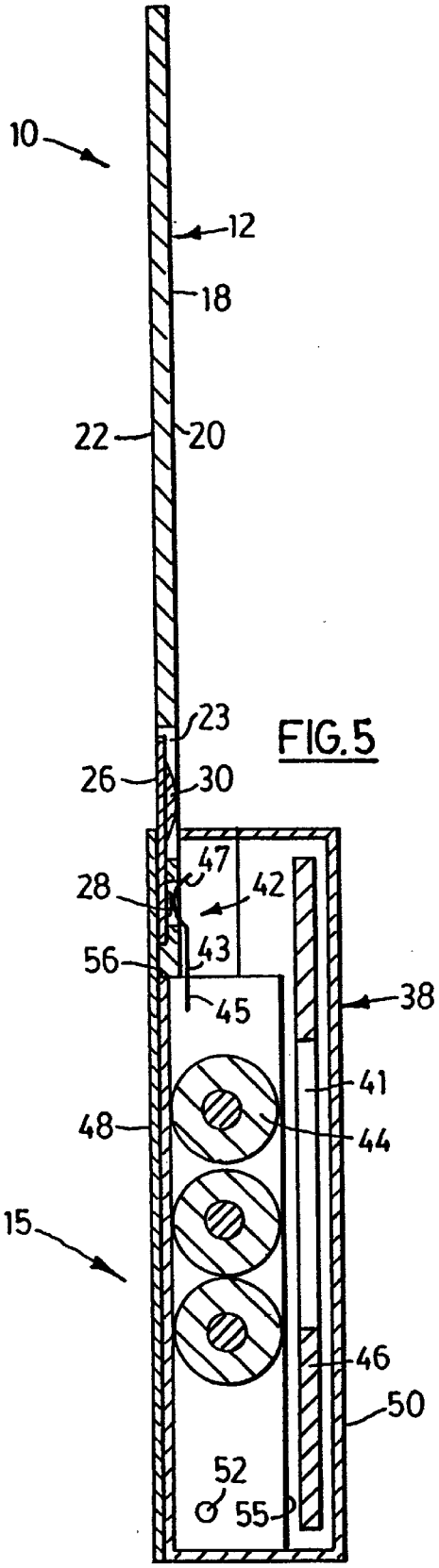
FIG.5
FIG.6
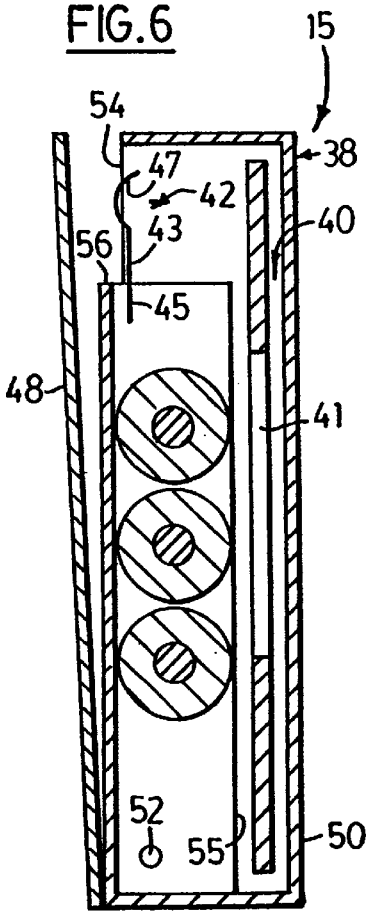

TALKING TRADING CARD PLAYER SYSTEM

RELATED APPLICATION

This application is a continuation-in-part of application Ser. No. 08/519,839 filed Aug. 25, 1995.

BACKGROUND OF THE INVENTION

This invention relates to collectable cards, and in particular, sports trading cards such as baseball cards, hockey cards and the like.

Baseball cards and other sports trading cards have been available since the turn of the century. These cards typically display an action photograph or other image of a baseball player or other athlete on the front face, and statistics and other personal information about the player on the back face. Collecting and trading baseball cards and other sports cards is a popular hobby engaged in by both children and adults. Sports cards tend to appreciate in value over the years, with rare cards such as the 1909 Honus Wagner baseball card being valued at several hundred thousand dollars.

In recent years, collecting sports cards has increased in popularity, particularly among younger collectors. Card manufacturers have responded to this increase in popularity by introducing innovations such as holographic logos and gold-plated collector sets. However, conventional sports trading cards are passive, and the type of information provided thereon has remained relatively constant over the years. The present inventors have recognized a need and demand for sports cards which provide more information and value than that available from conventional passive sports cards.

An active trading card, which provides sounds in addition to the standard graphics and text contained on a traditional trading card, is the subject of co-pending application Ser. No. 08/433,851 filed May 2, 1995, and owned by the Assignee of the subject application. This talking trading card is self-contained, in that the speaker assembly, the replaceable battery, and the electronic data storage and processing components are all built into the card. It also has a relatively thin card profile. However, this card construction places certain constraints on the size, quality and cost of the components thereof.

There exist card reading devices which utilize scanning mechanisms for reading information from cards. In some cases, these devices are used with trading cards as part an interactive sports game. The information is typically stored in the form of bar-codes or magnetic strips mounted on a card which is scanned by a reader device for use in the relevant application.

These prior art systems have certain disadvantages. They utilize mechanical or quasi-mechanical processes for scanning data and transforming it into an electrical format, which tend to suffer from data entry error arising from mechanical imprecision. Those prior art devices which utilize physical storage methods, for example magnetic strips, sometimes experience data integrity problems resulting from wear caused by frequent use. Data integrity may also be lost through unintentional physical contact between the user and these forms of exposed data storage. Furthermore, the data storage capability of a bar-coded or magnetic strip, or other mechanical or quasi-mechanical means, is very limited. The data so stored is therefore used typically as a key or reference to one of a set of data groups required, for instance, to execute an interactive sports game, and which is stored in the "player" part of the system. The data stored on such cards is inadequate in capacity for even a few seconds of digitized sound message, as offered by this invention.

These prior art systems also tend to be bulky, expensive, and not-easily portable. Accordingly, they are not well suited to the collection of trading cards.

SUMMARY OF THE INVENTION

The present invention relates to an improved talking trading card system which utilizes a trading card containing sound data stored on an integrated circuit chip embedded within the trading card, and a separate portable card player housing batteries and a speaker.

Eliminating the need for each card to contain its own power source and speaker components reduces the cost of each card. At the same time, placing the power source in the card player allows for the use of a wider range of power sources with various storage capacities and cost levels. The subject trading cards can also achieve a thinner profile than self-contained talking cards. Furthermore, the subject portable player is capable of producing higher quality and louder sound at a lower cost, than cards containing a speaker.

The subject trading card comprises a card body of predetermined dimensions having a front surface and a back surface. Electronic storage means for storing sound pattern data is located between the front surface and the back surface of the card body. Card contact means electrically connected to the electronic storage means enables electrical contact with the subject card player.

The corresponding subject portable player comprises a pocketsized player housing dimensioned to removably receive the card. The player housing contains sound generating means for generating sounds, power means for supplying electrical power to the sound generating means, and player contact means for making electrical contact with the card contact means.

The subject invention further comprises processing means for receiving sound pattern data from the storage means and sending electrical analogue signals to the sound generating means correlatable with the sound pattern data.

In a preferred embodiment, the subject trading card includes a card housing containing the electronic processing means, having flexible sheets containing graphics affixed to the front and back surfaces thereof. This card housing provides rigidity to the trading card, as well as added protection for the processing means.

The subject trading card is preferably provided with a rectangular aperture in the card housing shaped to fit a circuit board containing the electronic storage and processing means. The housing may include a support ledge near the aperture for supporting a portion of the circuit board, assisting to hold the circuit board in place. The card housing may also have a series of small circular apertures positioned to expose the card contact means located on the circuit board.

The currently preferred embodiment of the card player of the subject invention preferably comprises a portable pocket-sized player housing capable of successively playing a plurality of electronic trading cards, each trading card containing therewithin an electronic voice chip for processing stored sound pattern data, and having electrical contacts on the surface thereof for providing electrical contact with the voice chip data. Mounted within the housing are sound generating means for generating sounds from the sound data contained on the card and power means for supplying electrical power to the voice chip and sound generating means. The player housing further comprises retaining means on the top surface of the player housing for removably retaining a leading edge of a trading card and player contact means which protrude from the top surface of the player, thereby making electrical contact with the player contact means when pressure is applied to the face of the trading card forcing it to the top surface of the card player.

The card player retaining means preferably comprises a retaining wall extending upwardly from an edge on the top surface of the player housing and having a card retaining slot along the length of the inside face of the retaining wall, said retaining slot is shaped to receive the edge of a trading card and two parallel side walls extending upwardly from parallel edges of the top surface of the player housing.

The player contact means preferably comprises a plurality of thin narrow conductive contacts having one end fixed and extending from the circuit board within the player housing and the other end free with a curved tip, flexibly biased toward and protruding from the top surface of the player housing containing the retaining means and adapted to fit through the apertures of the card body to make contact with the card contact means.

BRIEF DESCRIPTION OF THE DRAWINGS

The present invention will now be described, by way of example only, with reference to the following drawings, in which:

FIG. 5 is a sectional view of the card and card player taken along lines 5—5 in FIG. 4; and FIG. 6 is a sectional view of the subject card player, with the card player cover in the open position;

DETAILED DESCRIPTION OF THE PREFERRED EMBODIMENT

Figure 1A:
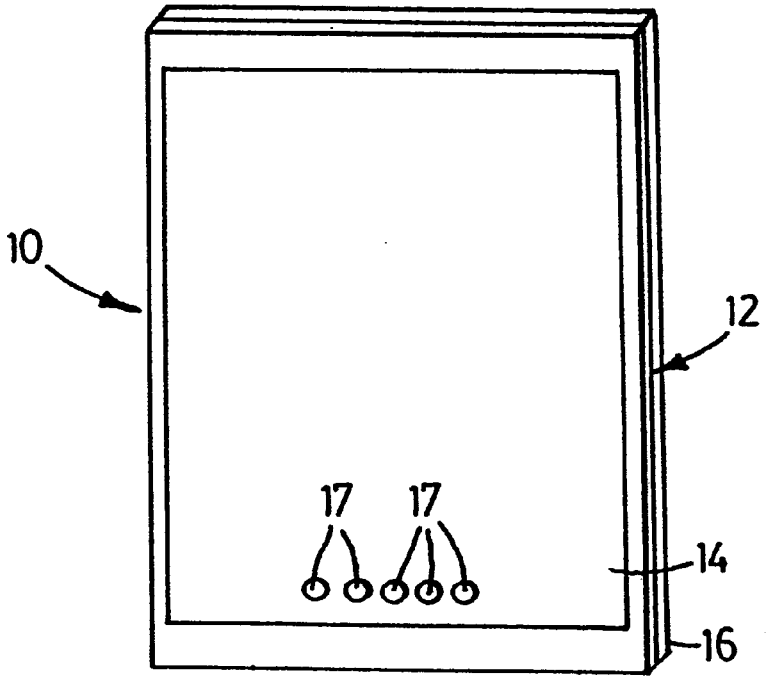
FIG. 1*a* is a perspective view of a preferred embodiment of a trading card made in accordance with the subject invention.
Figure 1B:
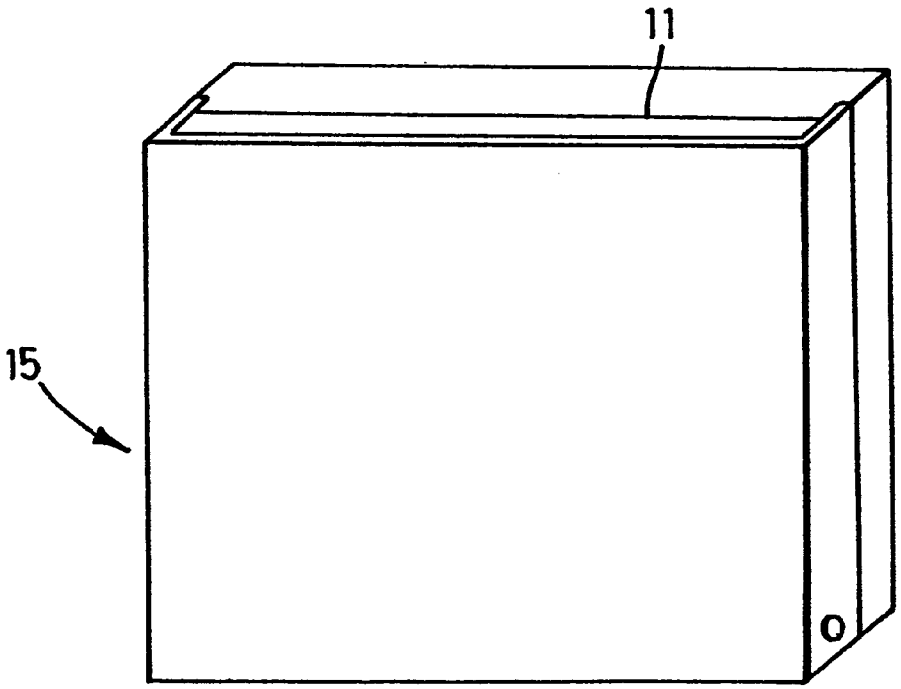
FIG. 1*b* is a perspective view of a preferred embodiment of a player made in accordance with the subject invention.

Referring to FIGS.1*a* and 1*b*, in a preferred embodiment, the talking trading card system of the subject invention comprises a trading card 10 dimensioned to fit into slot 11 of pocket-sized card player 15.

As shown in FIG. 1*a*, trading card 10 comprises a thin rectangular card housing shown generally as 12 having thin flexible sheets 14, 16, adhesively affixed to the front and back surfaces of card housing 12. Sheets 14, 16 are preferably made from card stock, paper, or other flexible substrates suitable for printing. Typically, front sheet 14 is printed with a reproduction of a colour photograph or other image of a sports player, and back sheet 16 is printed with statistics and other personal information about the player. Front sheet 14 is provided with a row of small circular sheet apertures 17 near the bottom edge thereof.

The dimensions of card housing 12 and flexible sheets 14, 16 are preferably equal to the dimensions of conventional sports trading cards, i.e. 2.5 by 3.5 inches. The thickness of housing 12 is preferably less than 2 mm.

Figure 3:
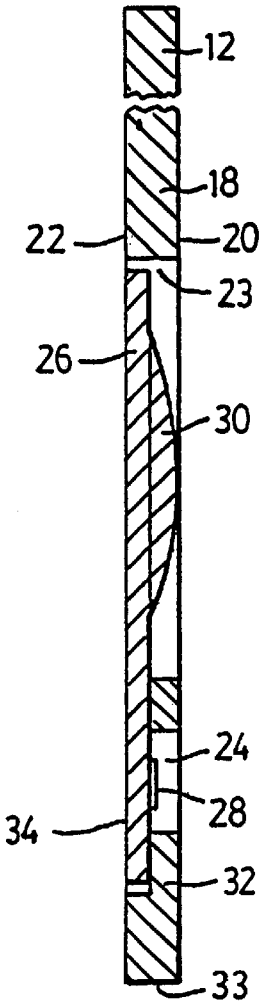
FIG. 3 is an expanded sectional view taken along lines 3—3 in FIG. 2.
Figure 2:
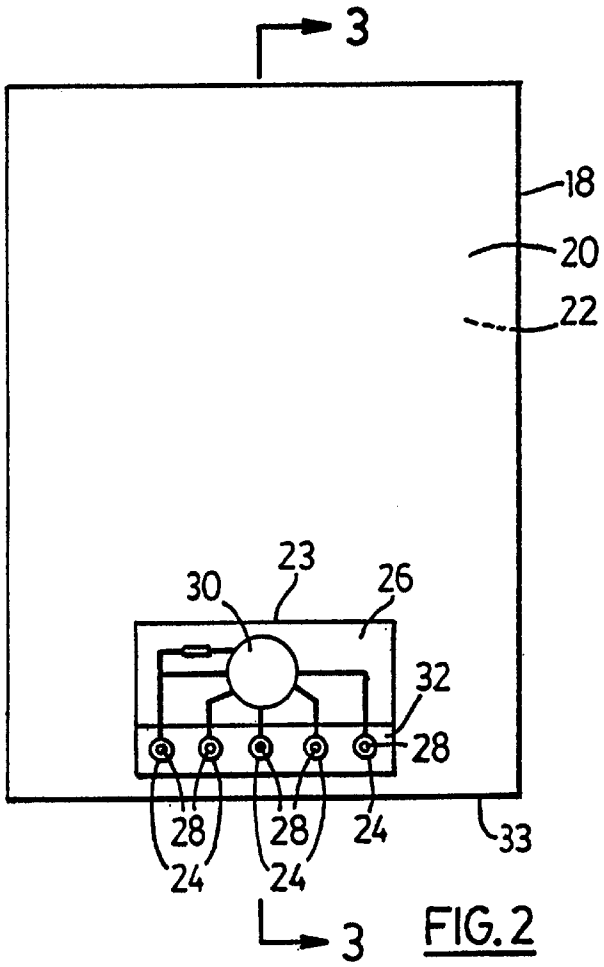
FIG. 2 is a front plan view of the subject card with the flexible sheets removed.

Referring now to FIGS. 2–3, card housing 12 comprises a flat panel 18 made of plastic, cardboard, or other light, rigid material, having flat front surface 20 and flat back surface 22. Panel 18 is provided with a large, rectangular aperture 23 sized to receive circuit board 26 containing card contacts 28 and voice chip 30.

As shown in FIG. 3, panel 18 includes support ledge 32 of reduced thickness near bottom edge 33 of panel 18 which provides support for lower portion 34 of circuit board 26 and assists in holding circuit board 26 in place. Ledge 32 is provided with a horizontal row of small circular panel apertures 24 situated below aperture 23, and spaced so as to expose card contacts 28. Sheet apertures 17 are likewise located to register with panel apertures 24 and contacts 28, when front sheet 14 is applied to card housing 12 as shown in FIG. 1.

Card contacts 28 are recessed below the top surface of card housing panel 18, and apertures 17 and 24 are relatively small, which makes it difficult for a person handling card 10 to touch card contacts 28 with his or her fingers. The protection to card contacts 28 from accidental contact by the person using card 10 provided by this structure reduces the possibility of discharging static electricity onto card contacts 28, which might damage voice chip 30.

Figure 4:
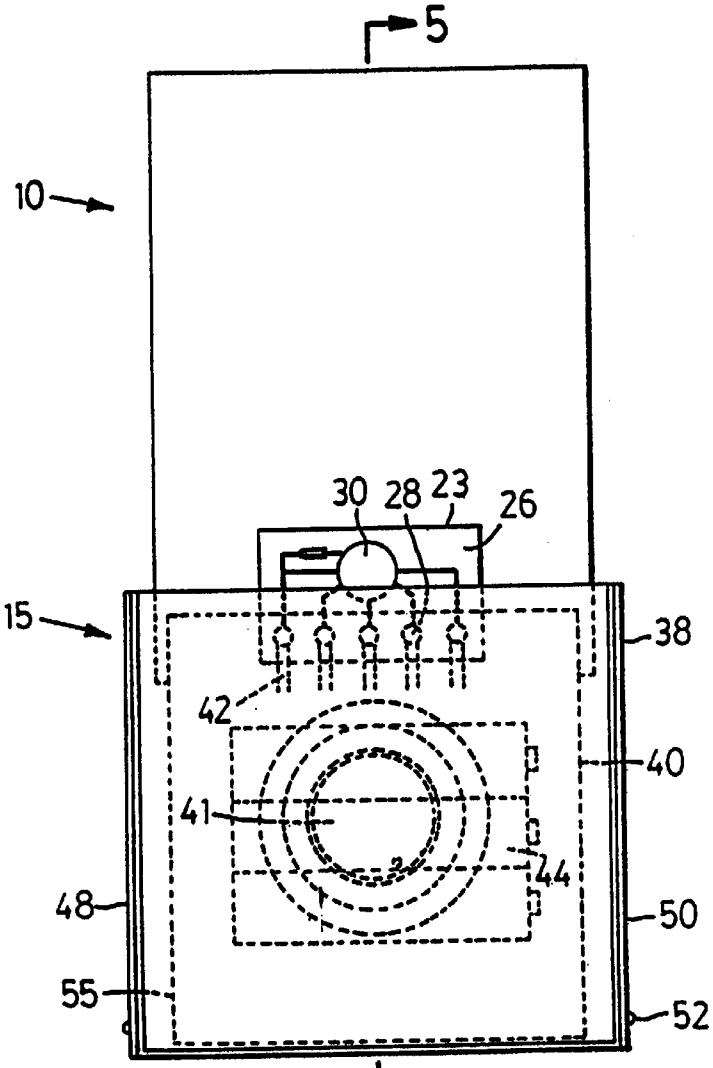
FIG. 4 is a front plan view of a preferred embodiment of a card player made in accordance with the subject invention, shown with a card physically and electrically connected therewith, and the card player cover in the closed position.

Referring now to FIGS. 4–6, in a preferred embodiment, card player 15, comprises a rectangular box-shaped housing shown generally as 38 containing speaker assembly 40, spring loaded player contacts 42 which make electrical contact with card contacts 28, and batteries 44 which provide electrical power to voice chip 30.

Player housing 38 includes cover 48 pivotally connected to base 50 by hinge 52. Cover 48 is pivotal between an open position as shown in FIG. 6 and a closed position as shown in FIG. 5. Player housing 38 includes card support platform 54, and battery compartment 55 shaped to hold batteries 44. The front edge of battery compartment 55 forms a card stop surface 56 which stops card 10 once it has been inserted far enough into player 15 such that player contacts 42 register with card contacts 28.

Player contacts 42 preferably take the form of five thin narrow and resilient metal contact strips 43, each having a fixed end 45 affixed in card stop surface 56. Contact strips 43 each extend partway along the card support platform 54, and have a free end with a curved tip 47 flexibly biased towards cover 48. Card support platform 54 is provided with recesses (not shown) shaped to fit player contact strips 43. In the closed position, shown in FIG. 5, cover 48 and card support platform 54 define thin, rectangular card insertion slot 11 (see FIG. 1*b*) shaped to accept the width and thickness of card 10.

When cover 48 is in the open position, as shown in FIG. 6, card 10 is slid into player 15 until the leading edge thereof abuts card stop surface 56, thereby registering player contacts 42 with card contacts 28. When cover 48 is moved to the closed position, as shown in FIG. 5, cover 48 applies pressure to card 10 forcing card contacts 28 onto and thereby making electrical contact with player contacts 42.

Having spring loaded player contacts 42 substantially in the form described prevents player contacts 42 and card contacts 28 from having to slide against each other, which would eventually cause wear.

Figure 7:
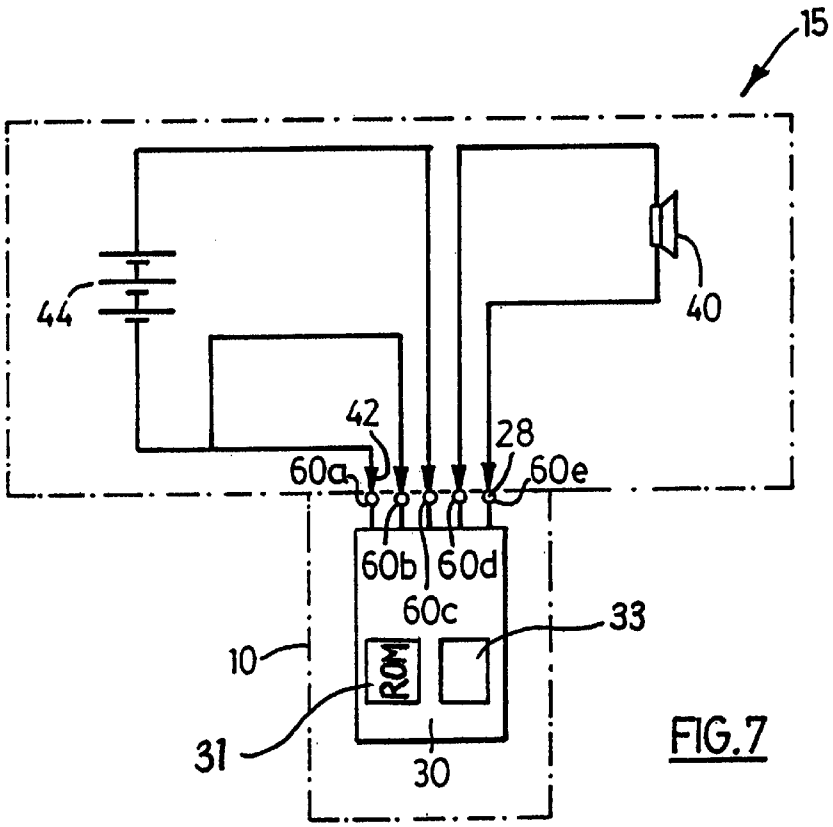
FIG. 7 is a simplified circuit diagram of the electrical components of the preferred embodiments of the card and card player when electrically connected.

Referring now to FIG. 7, voice chip 30 in card 10 is electrically connected to speaker assembly 40 and batteries 44 in player 15 by card contacts 28 and player contacts 42. Contact node 60*a* electrically connects the negative terminal of batteries 44 to voice chip 30 to provide input voltage. Contact node 60*b* electrically connects the negative terminal of batteries 44 to voice chip 30 and is used to activate voice chip 30, thereby initiating the playback of recorded sound. Contact node 60*c* electrically connects the positive terminal of batteries 44 to voice chip 30. Contact node 60*d* electrically connects the speaker assembly 40 to the electrical analogue output terminal of voice chip 30. Contact node 60*e* electrically connects voice chip 30 to speaker assembly 40, completing the circuit. Batteries 44 maintain voice chip 30 at a 4.5V input voltage.

Voice chip 30 may be a single chip integrated circuit utilizing VLSI technology, comprising a 360K ROM 31 for voice data storage, adapted to be powered by a power supply in the range of 2.4 volts to 5.0 volts. Voice chip 30 preferably includes processing means 33 capable of providing voice or other sound output of approximately 10–90 seconds long at a 5K sampling rate. Speaker assembly 40 preferably comprises a piezo-electric speaker 41 mounted in sounding board 46 as shown in U.S. Pat. No. 5,641,164, although speaker 41 could comprise a conventional magnetic speaker. Batteries 44 are preferably three 1.5 volt AA batteries in series supplying 4.5 volts of power.

Voice chip 30 generates a preselected output signal which recreates the sports player's voice or other recognizable voice or sound recording related to the person or event being featured on card 10. Voice chip 30 is typically programmed by the voice chip manufacturer, using a sound recording stored on an audio tape or the like. This sound recording is digitized by the manufacturer, using a sampling rate of 5K or the like, and etched into or otherwise permanently stored in ROM 31.

In operation, the voice chip 30 is activated by establishing electrical contact between player contacts 42 and card contacts 28, which completes the circuit shown in FIG. 7, thereby drawing current from batteries 44 to voice chip 30. In the preferred embodiment, electrical contact between player contacts 42 and card contacts 28 at contact node 60*b* is made a fraction of a second after the other electrical contacts have been established, as voice chip 30 requires the initiation signal to be sent after it has been energized. It should be noted, however, that some voice chips do not require the use of a separate, delayed initiation signal, in which case contact node 60*b* would not be required. The output signal of voice chip 30 through contact node 60*d* is an analogue signal capable of driving speaker 41, thereby generating sounds. When the output sound signal is completed, voice chip 30 automatically shuts off.

The card player 15 of the subject invention may be constructed in an inexpensive fashion to be thin and light and easily carried in the user's pocket, thereby offering true portability.

Referring now to FIGS. 8 to 12, illustrated therein is a currently preferred embodiment of a talking card player system made in accordance with the subject invention, comprising trading card player 80, and trading card 100.

Figure 8B:
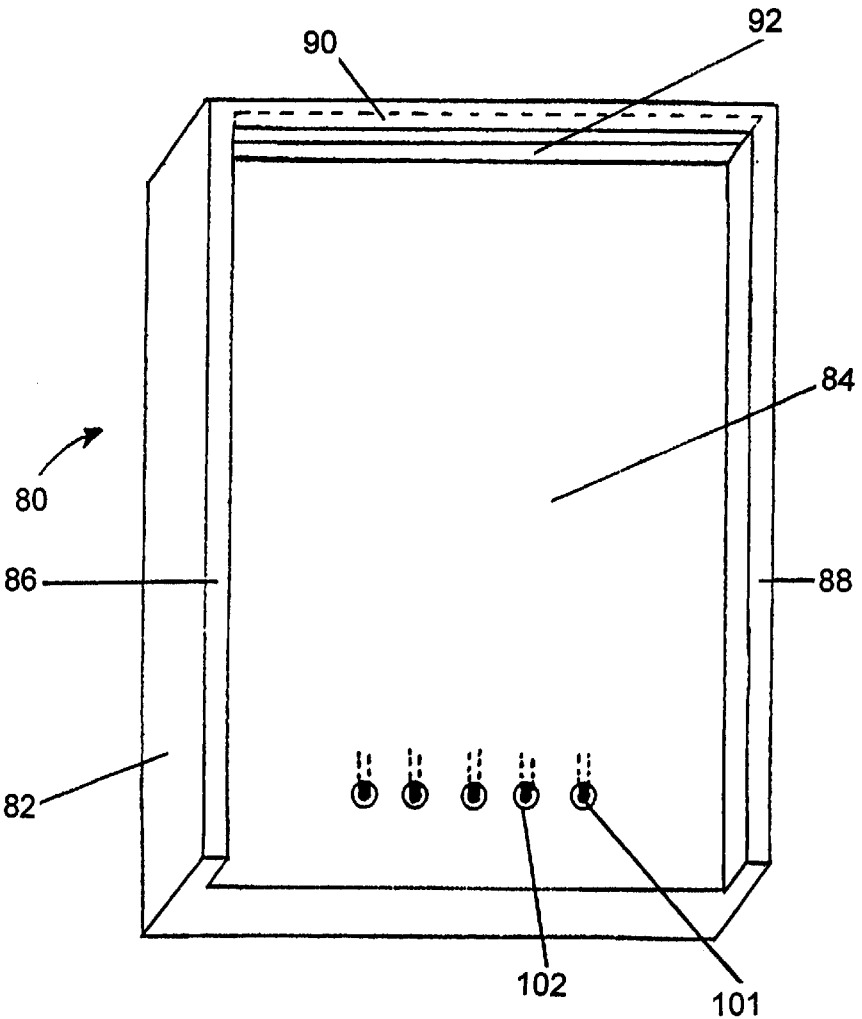
FIG. 8*b* is a perspective view of the currently preferred embodiment of the card player.
Figure 8A:
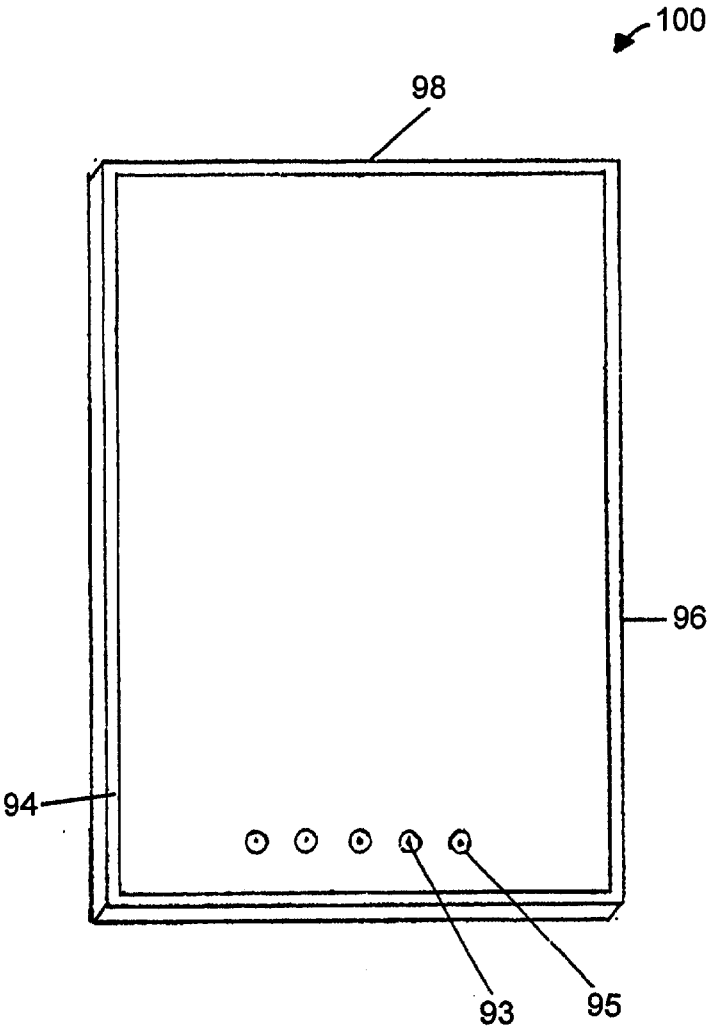
FIG. 8*a* is a perspective view of a trading card for use with the currently preferred embodiment of the card player.

Referring to FIG. 8*a*, trading card 100 and the components thereof are identical in construction to trading card 10 and the components thereof discussed hereinbefore. Trading card 100 includes a plurality of card contacts 93 recessed in spaced panel apertures 95.

Referring to FIG. 8*b*, trading card player 80 comprises a housing 82 having a flat top surface 84, surrounded by card positioning walls 86, 88 and top retaining wall 90. Left positioning wall 86 and right positioning wall 88 are spaced far enough apart to slideably receive left side edge 94 and right side edge 96 of trading card 100. Top retaining wall 90 is provided with a card retaining slot 92 shaped to receive top edge 98 of trading card 100. A plurality of spring contacts 101 project through spaced apertures 102 in flat top surface 84. Positioning walls 86, 88 and card retaining slot 92 in top retaining wall 90, assist in registering card contacts 93 with spring contacts 101.

Figure 9:
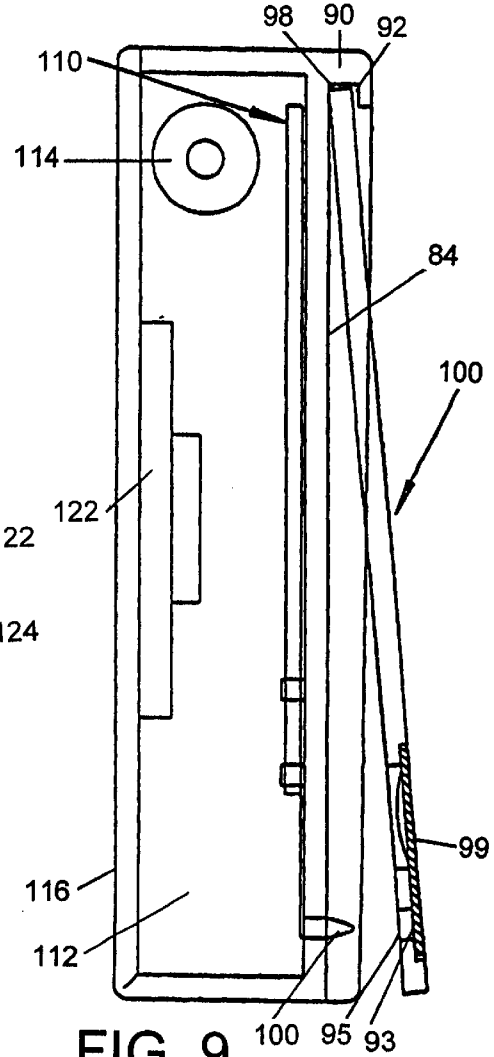
FIG. 9 is a sectional view of the currently preferred embodiment of the invention shown with a card partially inserted into the player.

Referring now to FIG. 9, trading card 100 is shown as it is about to be pressed against flat top surface 84 of the trading card player 80. Top edge 98 of trading card 100 is inserted into card retaining slot 92 in top retaining wall 90, which along with left positioning wall 86 and right positioning wall 88 helps align panel apertures 95 in trading card 100 with spring contacts 101 and prevents trading card 100 from moving from flat top surface 84 during play. Spring contacts 101 protrude through spaced apertures 103 in flat top surface 84 of trading card player 80 when not engaged with trading card 100. When trading card 100 is pressed to flat top surface 84, contact is made between spring contacts 101 and card contacts 93, allowing current to flow from circuit board 110 of trading card player 80 to circuit board 99 of playing card 100.

Figure 10:
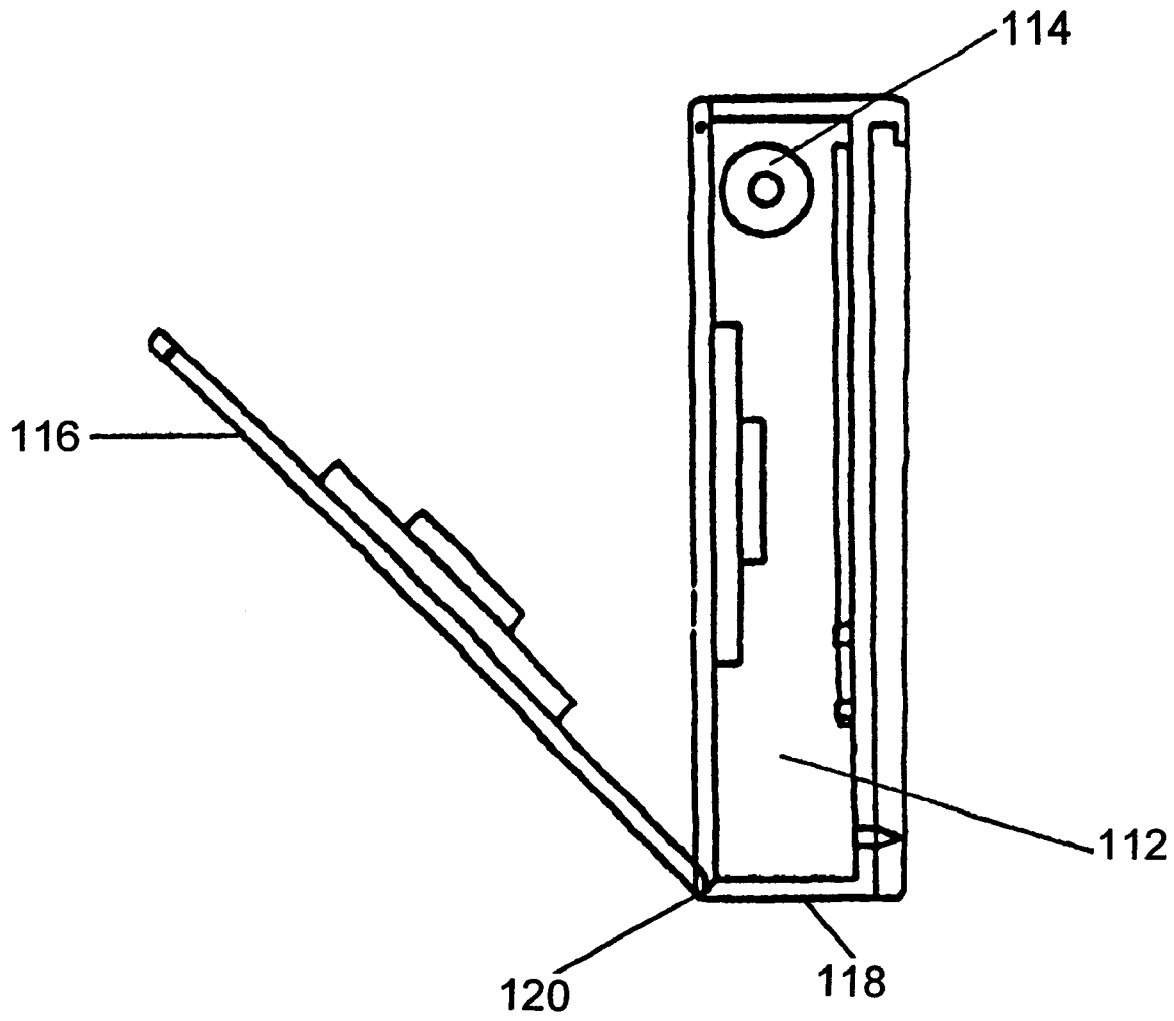
FIG. 10 is a sectional view of the currently preferred embodiment of the invention with the access door open.

Referring now to FIG. 10, body cavity 112 and batteries 114 are exposed by opening access door 116. Access door 116 is pivotally coupled to side 118 of housing 82 by a pliable living hinge 120. As shown, living hinge 120 comprises a triangular shaped notch transversely extending along the junction of side 118 and access door 116, but which could be replaced with any suitable hinge arrangement which permits access door 116 to be opened.

Figure 11:
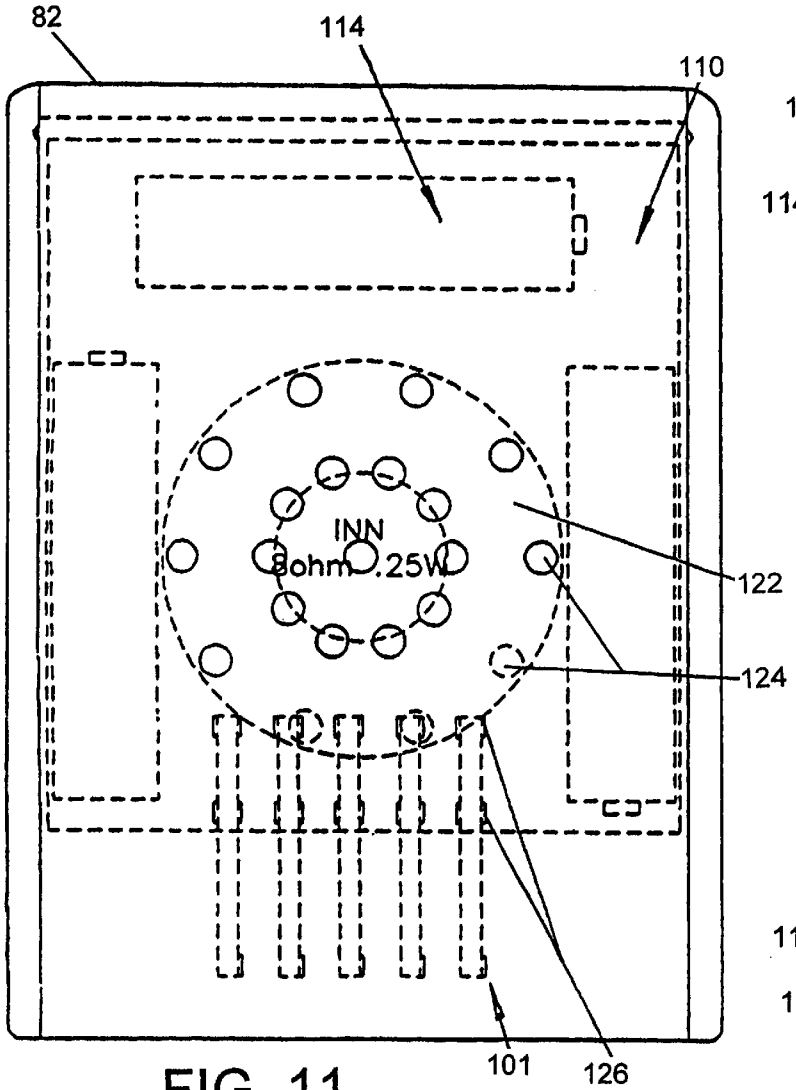
FIG. 11 is a rear plan view of the currently preferred embodiment of the invention.

Referring now to FIG. 11, batteries 114 are arranged around speaker 122 within body cavity 112 of housing 82. Such an arrangement ensures that batteries 114 do not obstruct any of the sound waves emanating from speaker 122. Batteries 114 are preferably three 1.5 volt AA batteries wired in series to provide 4.5 volts to circuit board 110. Contacts 101 are preferably spring metal contacts having circuit board contact points 126 attached to the face of circuit board 110 to allow an electrical circuit to be established between circuit board 110 and trading card 100. Speaker 122 is preferably mounted to the interior of access door 116 so that the cone of speaker 122 faces outward. The sound generated by speaker 122 is dispersed via two concentric rings of speaker holes 124 in access door 116, within the area covered by the speaker 122. As can be appreciated, the layout and design of speaker holes 124 is variable, their purpose being only to efficiently and accurately disperse the sound generated by speaker 122.

Figure 12:
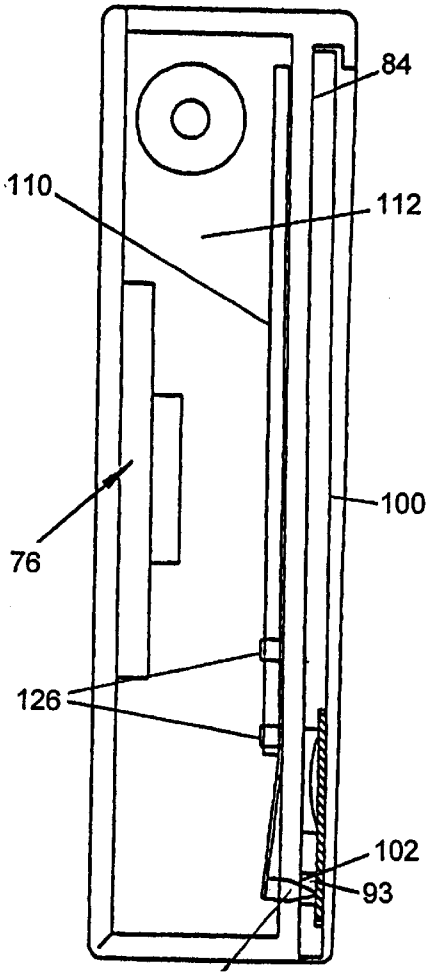
FIG. 12 is a section view of the currently preferred embodiment of the invention shown with a card electronically connected therewith.

Referring now to FIG. 12, when trading card 100 is engaged with trading card player 80, spring contacts 101 maintain contact with card contacts 93 while flexing backward into body cavity 112 of trading card player 80. Spring contacts 101 are attached to circuit board 110 with circuit board contact points 126 that extend through the circuit board 110 allowing spring contacts 101 to be easily connected to the electrical circuitry on circuit board 110 and allowing one end of spring contacts 101 to remain fixed to circuit board 110 while maintaining flexibility when making contact with card contacts 93.

In use, the user places trading card 100 on flat top surface 84 of trading card player 80 by positioning trading card 100 at an angle to flat top surface 84, and sliding the leading top edge 98 of trading card 100 into card retaining slot 92 in top retaining wall 90. Positioning walls 86, 88 help to guide trading card 100 into retaining slot 92. As the user pivots the trading card 100 downwardly, card contacts 93 are automatically aligned with spring contacts 101. Using a thumb or fingers the user then simply presses trading card 100 firmly against flat top surface 84 which engages card contacts 93 with spring contacts 101. This simple engagement process completes an electrical connection which results in the playing of the sound pattern data stored in trading card 100. After listening to the playing of the sound pattern data, the user then ceases applying pressure to trading card 100 and the electrical connection is broken. Trading card 100 is then removed from flat top surface 84 of trading card player 80.

While the subject invention has been illustrated and described as comprising a card containing an integrated circuit chip with both processing and data storage capabilities, the invention may comprise a card containing a chip with only data storage capability, with the player containing a chip with processing capabilities.

While the subject invention has been illustrated and described as comprising a card having a card housing comprising a flat housing panel preferably made of plastic, cardboard or other suitable material, a less expensive form of the card may forego the use of a housing panel and may simply consist of the front flexible sheet and the back flexible sheet affixed to each other and encapsulating the circuit board.

While the subject invention has been illustrated and described with respect to sports trading cards, it is equally applicable to other types of cards, such as cards pertaining to entertainment, politics, history, religion, nature and other applications.

Thus, while what is shown and described herein constitutes preferred embodiments of the subject invention, it should be understood that various changes can be made without departing from the subject invention, the scope of which is defined in the appended claims.

We claim:

1. A card player capable of successively playing a plurality of electronic trading cards, each trading card containing therewithin an electronic voice chip for processing stored sound pattern data, and having electrical contacts extending from the voice chip to a surface of the card, comprising:

(a) a portable pocket-sized player housing having a top surface dimensioned to receive the trading card, (b) sound generating means mounted in the player housing for generating sounds correlated with the sound pattern data stored on the card;

(c) power means for supplying electrical power to the voice chip and to the sound generating means;

(d) retaining means on the top surface of the player housing for removably retaining a leading edge of a trading card; and (e) player contact means extending through the top surface of the player housing for making contact with the electrical contacts on the surface of the card when the leading edge of the card is inserted into the retaining means and pressure is applied to the card forcing the electrical contacts on the surface of the card onto the player contact means.

2. The card player defined in claim 1, wherein the retaining means comprises a retaining wall extending upwardly from an edge of the top surface of the player housing and having a card retaining slot along the length of the inside face of said retaining wall, the retaining slot being shaped to receive the leading edge of the trading card.

3. The card player defined in claim 2, wherein the retaining means also comprises a pair of spaced parallel side walls extending upwardly from parallel edges of the top surface of the player housing, the side walls being spaced so as to slideably receive the side edges of the trading card.

4. The card player defined in claim 3, wherein the player contact means comprises a plurality of thin spaced narrow conductive player contacts, each of the contacts having a fixed end extending from a circuit board within the player housing and a free end with a curved tip flexibly biased toward and protruding through an aperture in the top surface of the player housing.

5. The card player defined in claim 4, wherein the bottom surface of the player housing comprises a hinged access door for providing access to the power means.

6. The card player defined in claim 5, wherein the power means comprises battery holding means for at least one battery.

7. The card player defined in claim 6, wherein the battery holding means comprises a battery compartment.

8. The card player defined in claim 7 wherein the sound generating means comprises a speaker mounted to the inside of the access door, the sound dispersing cone of said speaker facing the access door, and wherein the access door is provided with a plurality of holes to aid in the dispersal of sound emanating from said speaker.

9. A portable pocket-sized trading card playing system capable of generating sounds, comprising a card player and a plurality of cards, (a) wherein each card of the plurality of cards comprises a card body of predetermined dimensions and having a leading top edge, a front surface and a back surface, the front and back surfaces displaying graphics and text of interest to card traders, a voice chip located between the front surface and the back surface of the card body, the voice chip including electronic storage means for storing permanently digital sound pattern data representative of pre-selected patterns of sound, processing means for receiving sound pattern data from the electronic storage means and generating electrical analogue signals correlatable therewith, and card contact means, located on a surface of the card body near the bottom edge and electrically connected to the processing means for enabling electrical contact between the voice chip and the card player; and (b) wherein the card player comprises a player housing with a top surface dimensioned to receive a trading card, the player housing containing sound generating means for generating sounds and power means for supplying electrical power to the voice chip, retaining means for removeably retaining a leading edge of the card and player contact means extending through the top surface of the player housing for making electrical contact with the card contact means when the card is disposed on the top surface of the housing.

10. A portable pocket-sized trading card playing system capable of generating sounds, comprising a card player and a plurality of cards, wherein each card of the plurality of cards comprises a card body of predetermined dimensions and having a bottom edge, a front surface and a back surface, the front and back surfaces permanently displaying graphics and text of interest to card traders, a voice chip located between the front surface and the back surface of the card body having permanently stored thereon digital sound pattern data representative of preselected patterns of sound correlated with the graphics and text, the voice chip including processing means for receiving sound pattern data from the voice chip and generating electrical analogue signals correlatable therewith, and card contact means located on a surface of the card body near the bottom edge and electrically connected to the processing means for enabling electrical contact between the voice chip and the card player, wherein the card player comprises a player housing having a top surface dimensioned and shaped to removably receive the card, the player housing containing sound generating means for generating sounds, power means for supplying electrical power to the processing means and to the sound generating means, and player contact means extending through the top surface of the housing for making electrical contact with the card contact means when the card is disposed on the top surface of the housing.

11. The system defined in claim 10, wherein the voice chip comprises a read only memory having etched therein the digital sound pattern data.

12. The system defined in claim 10, wherein the card body comprises a card housing having a front housing surface and a back housing surface, a flexible front sheet affixed to the front housing surface and a flexible back sheet affixed to the back housing surface, the flexible sheets displaying said graphics and text, wherein the voice chip is housed in the card housing.

13. The system defined in claim 12, wherein the voice chip and the card contact means are mounted on a circuit board housed in the card housing.

14. The system defined in claim 12, wherein the card contact means comprises a plurality of card contacts located on the circuit board, and the card housing is provided with a series of spaced small housing apertures located so as to expose the card contacts, wherein each of the card contacts is recessed within one of the small housing apertures, and wherein the diameter of each aperture and the depth of the recessing of the card contacts are selected to prevent a user's fingers from contacting the card contacts.

15. A portable card player for use with a trading card having electronically stored therein sound pattern data representative of preselected patterns of sound and having card contact means on a surface thereof for enabling electrical contact with the player, the player comprising:

(a) a player housing dimensioned to removably receive the card;

(b) sound generating means located in the player housing for generating sounds;

(c) power means located in the player housing for supplying electrical power to the trading card and to the sound generation means;

(d) player contact means located in the player housing for making electrical contact with the card contact means;

(e) wherein the player housing comprises a base and a cover hingedly connected thereto, the cover being movable between an open position and a closed position; and (f) wherein the player housing comprises a card support surface parallel to and spaced from the cover when the cover is in the closed position so as to define a card insertion slot, and wherein the player housing comprises card stop means for stopping the card once it has been inserted a pre-selected distance into the player, so that the card contact means registers with the player contact means and so that most of the front surface and the back surface of the card remains outside of the player for viewing by card traders.

16. A trading card for use with a portable card player having a player housing dimensioned to removably receive the card and containing sound generating means for generating sound, power means for supplying electrical power to the sound generating means and to the card, and player contact means extending through a surface of the housing for making electrical contact with the card, the card comprising a card body of predetermined dimensions and having a bottom edge, a front surface and a back surface, the front surface and the back surface displaying graphics and text of interest to card traders, electronic processing means sandwiched therebetween having permanently stored thereon digital sound pattern data representative of preselected patterns of sound correlated with the graphics and text and generating electrical signals correlatable with the sound pattern data, and card contact means electrically connected to the processing means for enabling electrical contact with the player contact means, wherein the card contact means comprises a plurality of card contacts recessed within apertures in a surface of the card near the bottom edge thereof.

17. The system defined in claim 12, wherein the graphics and text displayed on the flexible front sheet is correlated to the graphics and text displayed on the flexible back sheet.

* * * * *